US005272033A

United States Patent [19]

van Gageldonk et al.

[11] Patent Number: 5,272,033

[45] Date of Patent: Dec. 21, 1993

[54] METHOD OF FORMING VISIBLE IMAGES

[75] Inventors: Johannes F. J. van Gageldonk; Arnold B. M. H. van der Mey, both of Venlo; Lambertus M. L. A. van Sas, Helmond; Gerardus C. P. Vercoulen, Velden; Antoon L. Hoep, Molenhoek, all of Netherlands

[73] Assignee: Oce-Nederland B.V., Venlo, Netherlands

[21] Appl. No.: 687,013

[22] Filed: Apr. 18, 1991

[30] Foreign Application Priority Data

Apr. 18, 1990 [NL] Netherlands ..... 9000912

[51] Int. Cl.[5] ..... G03G 9/08

[52] U.S. Cl. ..... 430/122; 430/106; 430/106.6

[58] Field of Search ..... 430/122, 106, 106.6

[56] References Cited

U.S. PATENT DOCUMENTS

| | | | |
|---|---|---|---|
| 3,895,125 | 7/1975 | Tsuchiya et al. | 430/122 |
| 4,187,330 | 2/1980 | Harada et al. | 430/122 |
| 4,443,527 | 4/1984 | Heikens et al. | 430/106.6 |
| 4,760,007 | 7/1988 | Takasu et al. | 430/122 |
| 5,053,305 | 10/1991 | Aoki et al. | 430/122 |

FOREIGN PATENT DOCUMENTS

| | | |
|---|---|---|
| 0057585 | 10/1982 | European Pat. Off. . |
| 0304983 | 3/1989 | European Pat. Off. . |
| 3008862 | 9/1980 | Fed. Rep. of Germany . |
| 3008881 | 9/1980 | Fed. Rep. of Germany . |

*Primary Examiner*—Marion E. McCamish
*Assistant Examiner*—Mark A. Chapman
*Attorney, Agent, or Firm*—Birch, Stewart, Kolasch & Birch

[57] ABSTRACT

A method of forming visible images in which magnetically attractable toner powder comprising resin particles containing magnetically attractable material is introduced to an image forming zone between an image registration medium and a moving conveying medium which has, within said image forming zone, a magnetic induction of at least 0.2T at its surface, thus imparting a force of attraction on the toner powder in which image forming zone the toner powder is selectively deposited on the image registration medium by electrostatic attraction in accordance with an image pattern, the toner powder used containing no more than 3% by volume of the magnetically attractable material.

4 Claims, 1 Drawing Sheet

METHOD OF FORMING VISIBLE IMAGES

BACKGROUND OF THE INVENTION

1. Field of the Invention

The present invention relates to a method of forming visible images in which magnetically attractable toner powder comprising resin particles containing magnetically attractable material is introduced to an image forming zone between an image registration medium and a moving conveying medium which exerts a magnetic force of attraction on the toner powder, such that the toner powder is selectively deposited on the image registration medium in the image forming zone by electrostatic attraction in accordance with an image pattern.

2. Discussion Of Related Art

According to a process taught by U.S. Pat. No. 4,154,520, latent electrostatic image patterns on an image registration medium are developed in a copying machine by means of toner powder fed by a magnetic conveying medium in the form of a magnetic brush The circumferential speed of the magnetic brush according to this method should be at least twice that of the speed of conveyance of the image registration medium and preferably three to five times such speed. The reason for this is that at low circumferential speed of the magnetic brush developing problems occur, such as inadequate gradation, deposition of toner particles outside the image patterns, and toner accumulation or over-development These developing problems ultimately lead to poor image quality of the copy.

Although such developing problems can be minimized by the use of a much higher circumferential speed, the higher brush speed is not without problems due to the increased mechanical load placed on both the image registration medium and the toner powder. As a result of the higher mechanical load, fine abrasive dust forms in the powder brush and is thrown from the latter, thus causing soiling of the copying machine. In addition, fine abrasive dust is also permanently deposited on the image registration medium, thus reducing its life.

Thus, in order to ensure proper functioning of the copying machine regular cleaning of the machine is required.

SUMMARY OF THE INVENTION

Therefore, it is an object of the present invention to provide an electrostatic imaging system which will overcome the above-noted disadvantages.

It is a further object of the present invention to provide a novel electrostatic imaging method.

Still, a further object of the present invention is to provide a method of electrostatic imaging utilizing a novel magnetic toner powder.

A further object of the present invention is to provide a magnetic brush development process for an electrostatic imaging system at low circumferential speed of the magnetic brush.

The foregoing objects and others are accomplished in accordance with the present invention, generally speaking, by providing a toner conveying medium which forms an image forming zone with an image registration medium, such that a magnetic induction (magnetic field strength) of at least 0.2T (tesla) is exerted on the toner at its surface within the image forming zone, exerting an attracting force on the toner powder, and wherein the toner powder used contains not more than 3% by volume of a magnetically attractable material. As a result, the production of a good image quality becomes substantially independent of the circumferential speed of the developing brush formed of the toner powder and hence a low circumferential speed of the magnetic brush can be selected which will eliminate dust problems.

The results of the method according to the present invention are further enhanced if the magnetically attractable material used in the toner powder is a soft-magnetic material, such as carbonyl iron. The present invention, therefore, also relates to a toner powder for use in the above image method, consisting of thermoplastic resin binder containing magnetically attractable material and possibly other additives, such as a coloring pigment material, a charge-control agent and electrically conductive material. The characterizing feature is that the toner particles contain a maximum of 3% by volume of a soft-magnetic material, the toner particles having an effective magnetic susceptibility of at least 2.

DETAILED DESCRIPTION OF THE INVENTION

Figure 1:
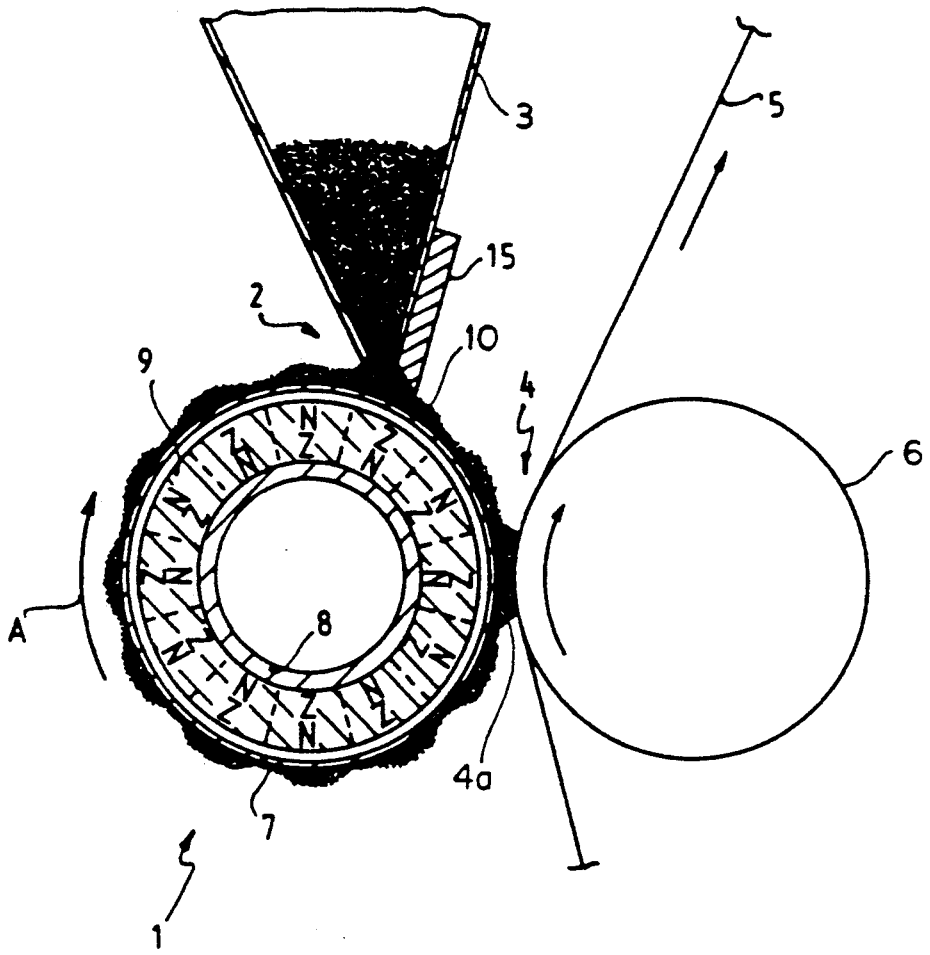
FIG. 1 is a diagrammatic cross-section of a device for developing an electrostatic image pattern using the method according to the present invention.

The invention will now be explained with reference to the following description and accompanying drawing identified as FIG. 1, which is a diagrammatic cross-section of a device for developing an electrostatic image pattern using the method according to the present invention.

The development device of FIG. 1 comprises a magnetic roller 1 as the toner conveying medium to which a magnetically attractable toner powder 10 is applied via the opening 2 of the reservoir 3. The toner powder 10 is conveyed to the developing (imaging) zone 4 where the powder is brought into contact with an image registration medium, herein represented as a photo-conductive material 5 in sheet or web form, which is fed over a backing roller 6, and bears a latent electrostatic charge image on the side of the sheet or web facing the layer of toner powder. The magnetic roller 1 comprises a sleeve 7 of diamagnetic material, e.g. aluminum, brass or stainless steel, which is rotatably mounted on a shaft 8 in a known manner. In the present illustrations, when the device is in operation, the sleeve 7 is driven in the direction of arrow A by a known drive means. The shaft 8 of the magnetic roller 1 is fixed, for example, in frame plates of the development device. As seen in the axial direction, cylindrical magnets 9 are mounted side-by-side on the shaft 8. These cylindrical magnets may be magnetized a number of times circumferentially so as to embody the required number of magnetic poles or be built up from a number of identical cylindrical segments magnetized one or more times. Magnets 9 are so disposed around the shaft such that like poles are situated in extension of one another and thus together form an axially extending magnetic pole. The outside diameter of the cylindrical magnets 9 is smaller than the inside diameter of the diamagnetic sleeve 7. The result is a homogeneous strong magnetic field at the surface of the diamagnetic sleeve 7.

A magnetic induction of at least 0.2T is required at the surface of the magnetic roller 1 in the development zone 4 for the method of the present invention. This can be achieved by making the magnets 9 from a highly magnetic material, such as an alloy of Neodynium-iron-boron or of Samarium-cobalt.

The magnetically attractable toner powder is applied to the sleeve 7 of the magnetic roller 1 via the opening 2 of the reservoir 3. The opening 2 extends axially over the sleeve length. A scraper 15 is provided at the opening 2, also extending axially over the sleeve length, in order to spread the applied toner powder over the sleeve 7 in a uniform layer. The layer of toner powder 10 applied to the sleeve 7 is conveyed by the sleeve 7 to the developing zone 4, where the toner powder is formed into a developing brush 4*a* in the magnetic field operative between one of the magnetic poles of the magnetic roller 1 and the backing roller 6. In this manner the toner is brought into contact with the electrostatic latent image to be developed, so that a powder image selectively forms on the image registration medium 5. The toner powder not transferred to the electrostatic image is then held against the sleeve 7 by the magnetic poles and thus returned to the powder supply zone by the sleeve 7.

According to the method of the present invention, the above-described developing device uses a magnetically attractable toner powder comprising toner particles containing a binder and between 0.25 and 3% by volume of a magnetically attractable material. If required, the toner particles may also contain other additives such as a coloring (pigment) additive, a charge-control material and/or electrically conductive particles. The best results are obtained by using a soft-magnetic material, e.g. carbonyl iron, as the magnetically attractable material. The most important properties which make the soft-magnetic material so suitable are the intrinsic magnetic susceptibility (X), which is greater than 10, and the form of the magnetization curve. By magnetic susceptibility (X) is meant the ratio of the magnetization of the material to the magnetic field applied. The greatest effect with respect to magnetization is obtained if the magnetic material does not become magnetically saturated at the magnetic field strength applied in the developing zone, since in the saturation part of the magnetization curve of the magnetic material, the magnetization is hardly influenced, if at all, as a result of an increase of the field strength. With the magnetic field strength used according to the present invention, the magnetic saturation level is sufficiently high for soft-magnetic materials. The magnetic susceptibility (X) of the material itself is also influenced, when used in toner particles, by the form of the magnetic material and the interaction with other magnetic material particles. A value between 2 and 6 for the effective magnetic susceptibility $X_{eff}$ of the toner particles appears to be a suitable value to give a good result with the method according to the invention.

With conventional developing devices according to the state of the art, in which a magnetic roller having a magnetic induction of approximately 0.08T is used in combination with a toner powder containing at least 20% by volume of magnetically attractable material, a good image quality (i.e. no background, high optical density and the like) is obtained only if the circumferential speed of the developing brush is at least twice the speed of conveyance of the image registration medium.

With the combination according to the present invention, a magnetic roller having a magnetic induction of at least 0.2T and a toner powder having at most 3% by volume of a magnetic material, it has been found that good image quality can be obtained substantially independent of the circumferential speed of the developing brush. Thus, a low speed can be selected which accordingly reduces dust problems. The strong magnetic field also contributes to a reduced dust formation in that a more compact toner brush 4*a* is created from which it is difficult for toner particles to escape.

In tests implementing the configuration shown in the accompanying drawing, using a magnetic roller 1 having a magnetic induction of 0.32T in the developing zone 4, with a toner powder containing 2% by volume of magnetically attractable material, excellent image quality was obtained at a circumferential speed in the imaging zone of the sleeve 7 equal to the speed of conveyance of the image registration medium or material 5. Tests with other combinations of the determining parameters (magnetic field strength and percentage of magnetic material by volume) did not yield results as good as this. Combinations of a strong magnetic brush (>0.2T) and a toner powder containing 20% by volume of magnetic pigment for example, always produced a background irrespective of the circumferential speed of the developing brush, while a magnetic brush of 0.08T with toner powder containing less than 3% by volume of the magnetic pigment did not prove to yield a charge image development at all acceptable, at any speed whatsoever.

The more compact toner brush resulting according to the present invention necessitates strict requirements with respect to the distance between the image registration medium 5 or photo-conductive material and the surface of the sleeve 7 of the magnetic roller 1 in the developing zone in order to ensure that the toner powder makes contact with the latent electrostatic charge image. Therefore, in the above specifications of the magnetic field and toner powder is preferred that the distance between the surface of the development roller and the image registration medium does not exceed 0.1 mm.

The toner particles used in the method according to the present invention can be produced by a known method in which the binder (often a thermoplastic resin) is melted, and the magnetically attractable material, as well as other fine solid particles such as coloring constituents, a charge-control agent and/or the electrically conductive material, are distributed in the melt, whereupon after cooling the mass is ground into fine particles. Another method comprises making the toner powder particles by spray-drying a dispersion of the fine solid particles in a solution or a dispersion of the resin.

If necessary, the toner particles can also be made electrically conductive, as indicated above, by adding conductive material, e.g. carbon particles, to the melt or dispersion or by afterwards softening the toner particles and causing electrically conductive particles to stick to the surface of the toner particles. By this latter method, the fine conductive particles are anchored in the surface of the softened toner powder particles.

In order to obtain toner powder of which all particles are magnetically attractable sufficiently enough to be employed in the method according to the present invention, the relation between the particle size of the magnetically attractable material and the minimum particle size of the toner powder itself is important. When using the finer fractions of the magnetically attractable material with a particle size of between 1 and 3 μm, there is no need for making special demands upon the minimum particle size of the toner powder containing between 1 and 3% by volume of the magnetically attractable material. In that case, the particle size of the toner powder may be in the usual range of from 5–8 μm up to 30 μm or more. In order that the coarser fractions of the magnetically attractable material in the range between 1 and 10 μm might also be employed, in such a toner powder the lower limit for the particle size of the toner powder should be selected higher according to the average particle size of the magnetically attractable material as it is increased. Generally speaking, this lower limit of the particle size of the toner powder should be 8, 10, 15 and 20 μm respectively, when the magnetically attractable material has a particle size of $<2$, 2–3, 5 and 10 μm respectively. Suitable toner particles containing less than 1% by volume of the magnetically attractable material ca be obtained by applying magnetically attractable material with a particle size of up to about 2 μm. It than follows that the lower limit for the particle size of the toner powder will be selected at a higher level, as the percentage by volume of the magnetically attractable material becomes lower. In the case when 0.5% by volume of the magnetically attractable material is used, the lower limit for the toner powder is approximately 15 μm, while in case of 0.25% by volume of magnetically attractable material the lower limit is approximately 20 μm.

PREFERRED EMBODIMENTS

Example 1

An electrically conductive toner powder containing 2% by volume of a magnetically attractable material is prepared, for example, by melting a thermoplastic resin in the form of a polyester resin of the Atlac type made by Imperial Chemical Industries, and distributing fine solid particles of carbon and carbonyl iron homogeneously in the melt, the different materials being used in the proportion of 86.81% by weight of polyester resin, 11.71% by weight of carbonyl iron (particle size 2–3 μm) and 1.48% by weight of carbon.

After cooling of the melt, the mass is ground into powder particles having a particle size of between 5 and 40 μm.

Example 2

Another toner powder according to the invention containing 0.5% by volume of magnetically attractable material is prepared by melting a polyester resin of the type described in Example 1 and distributing carbon and carbonyl iron particles in the melt, the materials being used in the proportion of 95.4% by weight of polyester resin, 3.13% by weight of carbonyl iron (particle size 1–2 μm) and 1.47% by weight of carbon. The cooled mass is ground to give powder particles having a particle size between 15 and 40 μm.

The powder particles produced by one of the above-described methods of Examples 1 and 2 are rendered electrically conductive by softening the powder particles and causing conductive particles to stick to their surface in the manner described in Example II of Netherlands Patent Application NL-A 7203523. This produces a magnetically attractable, electrically conductive developing powder having a specific resistance below $10^{12}$ ohm.cm and preferably between $10^7$ and $10^8$ ohm.cm, measured by means of the cell resistance measurement as described in the same Netherlands patent application.

Although the method according to the present invention has been described for use in a magnetic brush developing device for electrostatic charge patterns, the invention is not limited thereto. It is not necessary to convey the toner powder particles to the developing zone by means of a magnetic brush, it naturally being possible to use any desired conveying means for this purpose.

On the other hand, the method according to the invention can also be used in an electrostatic printer of the type described, for example, in U.S. Pat. No. 4,704,621. A printer of this kind comprises a movable image forming element having a dielectric surface, and an image forming station disposed along the trajectory of the image forming element, the station comprising a magnetic roller having an electrically conductive sleeve near the surface of the image forming element and means for generating an electric field corresponding to an information pattern between the image forming element and the magnetic roller. By supplying electrically conductive magnetically attractable toner powder having the specifications described hereinabove to the zone between the image forming element and the magnetic roller and applying a magnetic field in accordance with the present invention, an image of excellent quality is also produced with this printer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of forming visible images utilizing magnetically attractable toner powder which comprises:

providing a magnetically attractable toner powder comprising resin particles and a magnetically attractable material in an amount not greater than 1% by volume of said toner powder, said magnetically attractable material being provided in a particle size not greater than 2 μm, said toner powder having a particle size lower limit of about 10 μm, which particle size lower limit is progressively increased as the percentage by volume of said magnetically attractable material is decreased; and introducing said magnetically attractable toner powder into an image forming zone between an image registration medium and a magnetized moving toner conveying medium, such that a magnetic field strength represented by a magnetic induction of at least 0.2T is exerted on said toner powder at its surface within said image forming zone, wherein in said image forming zone said magnetically attractable toner powder is selectively deposited on said image registration medium by electrostatic attraction in conformance with an image pattern.

2. A method according to claim 1, wherein said magnetically attractable material in said toner powder is a soft-magnetic material.

3. A toner powder for use in a magnetic development system, comprising thermoplastic resin particles and not more than 1% by volume of a soft-magnetic material with a particle size not greater than 2 μm, said resin particles having an effective magnetic susceptibility of at least 2, said toner powder having a particle size lower limit of about 10 μm when said toner powder contains said 1% by volume of said soft-magnetic material, said lower limit of said particle size of said toner powder being raised as the percentage by volume of said soft-magnetic material is decreased.

4. A toner according to claim 3, wherein said soft-magnetic material consists of carbonyl iron.

* * * * *